US009946276B2

(12) United States Patent
Bhattad et al.

(10) Patent No.: US 9,946,276 B2
(45) Date of Patent: Apr. 17, 2018

(54) VOLTAGE REGULATORS WITH CURRENT REDUCTION MODE

(71) Applicant: Dialog Semiconductor (UK) Limited, London (GB)

(72) Inventors: Ambreesh Bhattad, Swindon (GB); Frank Kronmueller, Neudenau (DE); Hande Kurnaz, Dettingen-Teck (DE)

(73) Assignee: Dialog Semiconductor (UK) Limited, London (GB)

( * ) Notice: Subject to any disclaimer, the term of this patent is extended or adjusted under 35 U.S.C. 154(b) by 0 days.

(21) Appl. No.: 15/429,217

(22) Filed: Feb. 10, 2017

(65) Prior Publication Data

US 2017/0322573 A1 Nov. 9, 2017

(30) Foreign Application Priority Data

May 4, 2016 (DE) ..... 10 2016 207 714

(51) Int. Cl.
*G05F 1/575* (2006.01)
*G05F 1/46* (2006.01)

(52) U.S. Cl.
CPC ..... *G05F 1/461* (2013.01); *G05F 1/575* (2013.01)

(58) Field of Classification Search
CPC ..... G05F 1/575; G05F 3/262; G01R 19/0092; H03K 4/50; H03K 17/166
USPC ..... 323/280–289, 311–317; 327/130–134, 327/530, 538, 543
See application file for complete search history.

(56) References Cited

U.S. PATENT DOCUMENTS 5,576,656 A * 11/1996 McClure ..... G05F 1/465 327/530
6,586,980 B1 * 7/2003 Callahan, Jr. ..... G05F 3/262 327/132
6,628,106 B1 * 9/2003 Batarseh ..... H02M 3/1584 323/222
7,005,881 B2 * 2/2006 Thiery ..... G01R 19/0092 324/609
9,829,906 B2 * 11/2017 Yamahana ..... G05F 3/262
(Continued)

OTHER PUBLICATIONS

German Office Action, File No. 10 2016 207 714.7, Applicant: Dialog Semiconductor (UK) Limited, dated Sep. 9, 2016, 8 pgs and English language translation, 10 pgs.

*Primary Examiner* — Rajnikant Patel
(74) *Attorney, Agent, or Firm* — Saile Ackerman LLC; Stephen B. Ackerman

(57) ABSTRACT

A voltage regulator provides an output current at an output voltage, based on an input voltage. The voltage regulator has a pass transistor for deriving the output current. The voltage regulator contains a drive transistor forming a current mirror in conjunction with the pass transistor, such that the output current through the pass transistor is dependent on a drive current through the drive transistor. The voltage regulator comprises an auxiliary transistor arranged such that at least a fraction of the drive current through the drive transistor flows through the auxiliary transistor. The voltage regulator has amplification circuitry to set the drive current through the drive transistor depending on the output voltage and on a reference voltage. The voltage regulator further contains control circuitry to detect an indication for a dropout situation where a difference between the input voltage and the output voltage falls below a dropout voltage.

25 Claims, 10 Drawing Sheets

(56) References Cited

U.S. PATENT DOCUMENTS

| | | | |
|---|---|---|---|
| 2004/0140845 | A1 | 7/2004 | Eberlein |
| 2006/0164053 | A1 | 7/2006 | Walter et al. |

* cited by examiner

VOLTAGE REGULATORS WITH CURRENT REDUCTION MODE

TECHNICAL FIELD

The present document relates to a voltage regulator. In particular, the present document relates to a voltage regulator exhibiting reduced internal losses and/or reduced internal current, notably in case of dropout situations.

BACKGROUND

Voltage regulators are frequently used for providing a load current at a stable load voltage to different types of loads (e.g. to the processors of an electronic device). A voltage regulator derives the load current from an input node of the regulator, while regulating the output voltage at the output node of the regulator in accordance to a reference voltage.

SUMMARY

The present document addresses the technical problem of providing a voltage regulator which exhibits reduced internal losses and/or reduced internal current, notably in case of dropout situations. According to an aspect, a regulator (notably a voltage regulator such as a low dropout regulator) is described. The voltage regulator is configured to provide an output current at an output voltage at an output node, based on an input voltage at an input node.

The voltage regulator comprises a pass transistor (notably an n-type MOS transistor) for deriving the output current at the output node from the input voltage at the input node. Furthermore, the voltage regulator comprises a drive transistor forming a current mirror in conjunction with the pass transistor, such that the output current through the pass transistor is dependent on (e.g. proportional to) a drive current through the drive transistor. In addition, the voltage regulator comprises an auxiliary transistor arranged such that at least a fraction of the drive current through the drive transistor flows through the auxiliary transistor. Furthermore, the voltage regulator comprises amplification circuitry configured to set the drive current through the drive transistor in dependence of the output voltage and in dependence of a reference voltage, if the voltage regulator is regulating the output voltage.

The voltage regulator further comprises control circuitry which is configured to detect an indication for a dropout situation for which a difference between the input voltage and the output voltage falls below a dropout voltage of the voltage regulator. The control circuitry is further configured, in reaction to this, to increase a resistance of the auxiliary transistor to reduce the fraction of the drive current flowing through the auxiliary transistor.

By increasing the resistance of an auxiliary transistor, the internal current of the voltage regulator may be reduced during dropout situations, thereby increasing the power efficiency of the voltage regulator.

According a further aspect, a corresponding method for operating a voltage regulator is described.

In the present document, the term "couple" or "coupled" refers to elements being in electrical communication with each other, whether directly connected e.g., via wires, or in some other manner.

BRIEF DESCRIPTION OF THE DRAWINGS

The invention is explained below in an exemplary manner with reference to the accompanying drawings, wherein.

DESCRIPTION

Figure 1A:
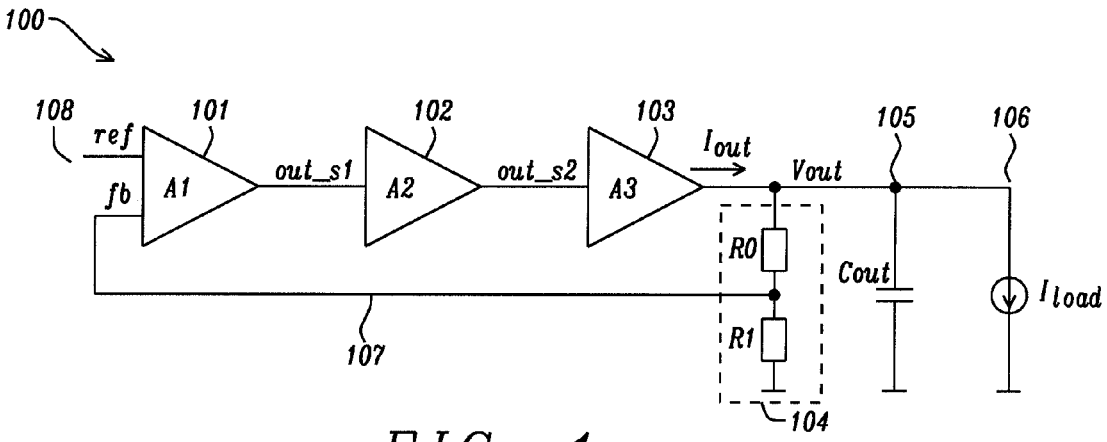
FIG. 1*a* illustrates an example block diagram of an LDO regulator.

As outlined above, the present document is directed at providing a voltage regulator with reduced internal losses. An example of a voltage regulator is an LDO (low dropout) regulator. A typical LDO regulator 100 is illustrated in FIG. 1*a*. The LDO regulator 100 comprises an output amplification stage or output stage 103, comprising e.g. a field-effect transistor (FET), at the output and a differential amplification stage 101 (also referred to as error amplifier) at the input. A first input (fb) 107 of the differential amplification stage 101 receives a fraction of the output voltage $V_{OUT}$ determined by the voltage divider 104 comprising resistors R0 and R1. The second input (ref) to the differential amplification stage 101 is a stable voltage reference $V_{ref}$ 108 (also referred to as the bandgap reference). If the output voltage $V_{OUT}$ changes relative to the reference voltage $V_{ref}$, the drive voltage to the output amplification stage, e.g. to the power FET (referred to as a pass transistor), changes by a feedback mechanism called main feedback loop (or voltage regulation loop) to maintain a constant output voltage $V_{OUT}$.

The LDO regulator 100 of FIG. 1*a* further comprises an additional intermediate amplification stage 102 configured to amplify the output voltage of the differential amplification stage 101. An intermediate amplification stage 102 may be used to provide an additional gain within the amplification path. Furthermore, the intermediate amplification stage 102 may provide phase inversion.

In addition, the LDO regulator 100 may comprise an output capacitance $C_{out}$ (also referred to as output capacitor or stabilization capacitor or bybass capacitor) 105 parallel to the load 106. The output capacitor 105 is used to stabilize the output voltage $V_{OUT}$ subject to a change of the load 106, in particular subject to a change of the requested load current or output current $I_{load}/I_{OUT}$.

Figure 1B:
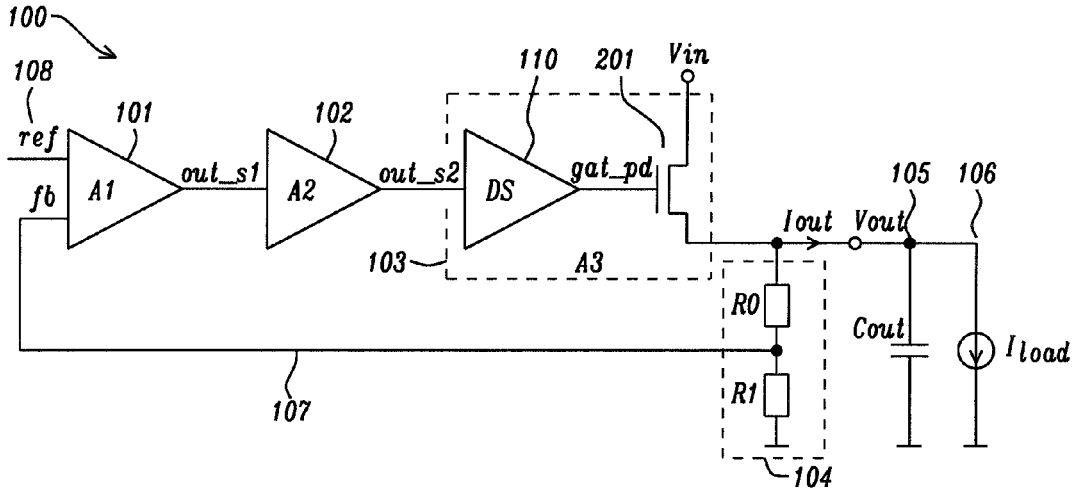
FIG. 1*b* illustrates the example block diagram of an LDO regulator in more detail.

FIG. 1*b* illustrates the block diagram of a LDO regulator 100, wherein the output amplification stage 103 is depicted in more detail. In particular, the pass transistor or pass device 201 and the driver stage 110 of the output amplification stage 103 are shown. Typical parameters of an LDO regulator 100 are a supply voltage of 3V, an output voltage of 2V, and an output current or load current ranging from 1 mA to 100 or 200 mA. Other configurations are possible.

The present document is directed at increasing current efficiency when a voltage regulator 100 (notably an NMOS LDO) is close to dropout or in dropout conditions. In such situations, the regulation of the voltage regulator typically causes relatively large internal currents while trying to maintain a stable operation condition (notably while trying to maintain a stable output voltage). In this context, it is desirable to maximize the gate drive (i.e. the gate voltage) for the pass transistor 201, wherein the gate drive may be dependent on the supply voltage of the voltage regulator 100 and/or on the input voltage Vin of the voltage regulator 100 and/or by stress limits of the oxide gate of the pass transistor 201. In the present document, circuitry is described which reduces the internal currents of the voltage regulator 100 in such a Loss-of-Regulation (LoR) condition (in particular in a dropout situation). The situation of a limited supply voltage and/or input voltage Vin may be considered to be a special case for such an LoR condition. In particular, the circuitry enables maximum allowable gate voltages for the pass transistor 201 (to reduce losses at the pass transistor 201) and reduced internal drive currents (to reduce internal losses of the voltage regulator 100) within a dropout situation.

Figure 1C:
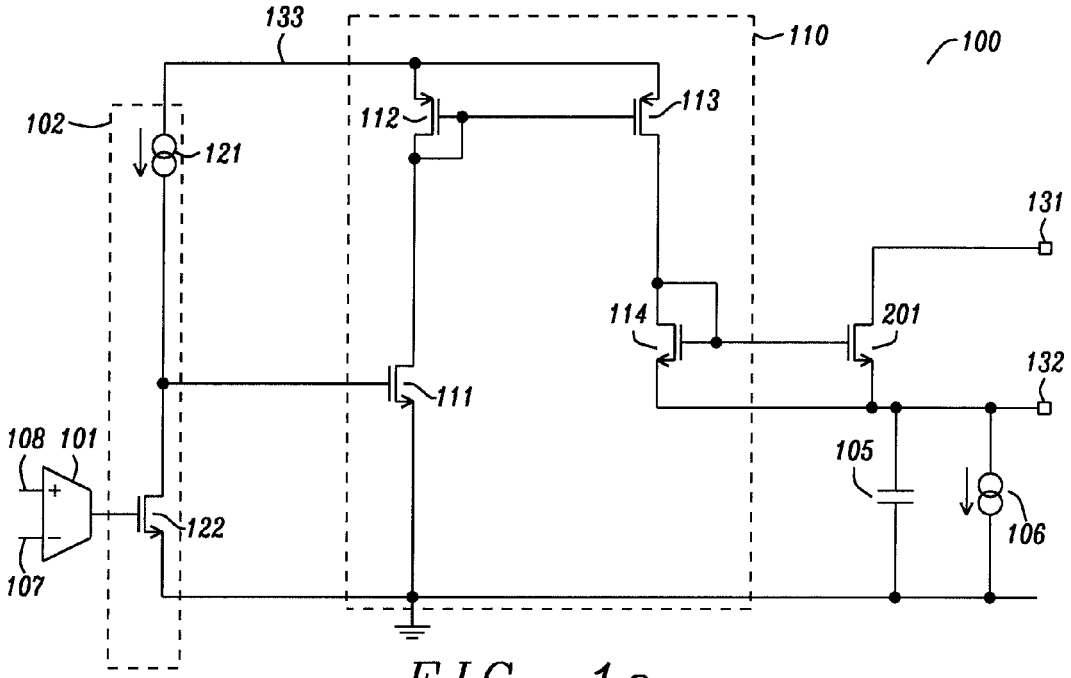
FIG. 1*c* shows a circuit diagram of an LDO regulator.

FIG. 1*c* shows a circuit diagram of a three-stage voltage regulator 100 comprising an NMOS output stage (with an NMOS pass transistor 201). The differential stage 101 is comparing the reference voltage 108 to the feedback voltage 107 (which is derived from the output voltage 132). The second stage 102 comprises a second stage input transistor 122 (NMOS) and a second stage current source 121, thereby providing a gain and allowing an increased signal swing. The third stage 110 comprises a drive current transistor 111 (NMOS) which drives the output current of the regulator 100 via the PMOS current mirror 112, 113 (also referred to as the second current 112, 113) and the NMOS current mirror 114, 201 (including the pass transistor 201 (NMOS)). The drain of the pass transistor 201 may be connected to a reduced input voltage Vin 131 (compared to the supply voltage VDD 133, which is used internally within the voltage regulator 100). In particular, the input voltage Vin 131 may be relatively close to the intended output voltage 132 in order to reduce power loss across the pass transistor 201.

Figure 2:
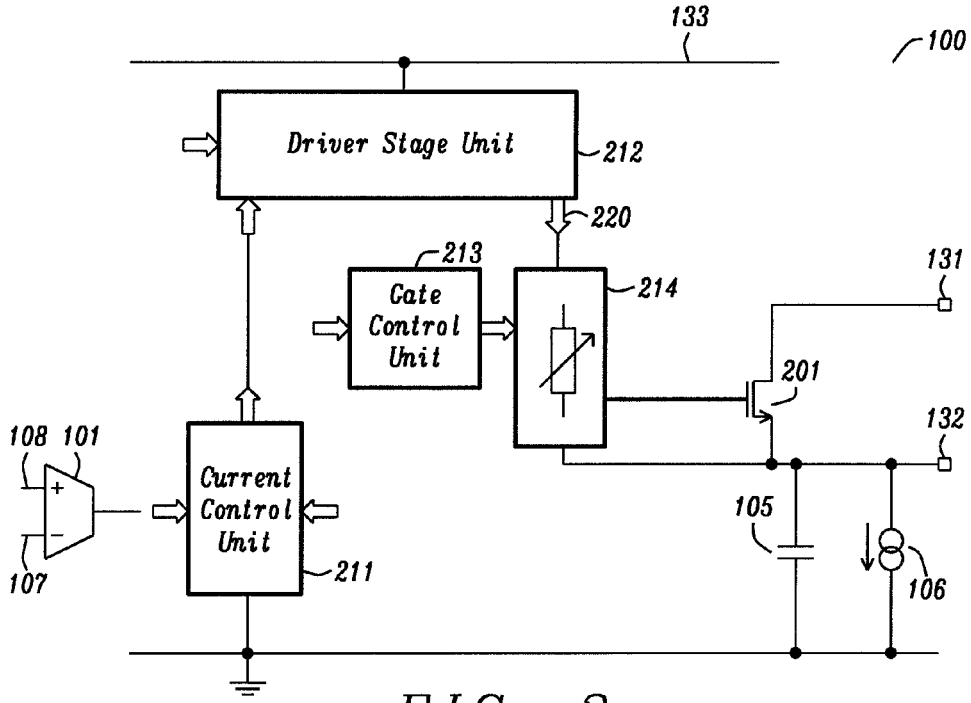
FIG. 2 shows a block diagram of a voltage regulator with an adjustable gain.

The voltage regulator 100 may comprise a variable impedance within the output stage 103, 110, 201. This is illustrated in FIG. 2. Furthermore, the voltage regulator 100 may comprise a gain control unit 213 which controls the variable impedance unit 214 of the regulator 100, in order to reduce the drive current 220 which is amplified by the NMOS current mirror 114, 201, thereby reducing the internal current of the voltage regulator 100. The variable impedance unit 214 may be activated, if the overall gain from the input of the voltage regulator 100 to the output of the regulator 100 is reduced by an event which causes gain loss. Such a gain reduction of the voltage regulator 100 may be caused when reaching a lower limit of the input voltage 131 or when reaching a critical VGS (gate-source) voltage across the pass transistor 201. The variable impedance unit 214 may act as a current limit in order to limit the internal current of the voltage regulator 100. The limit of the internal current may change the internal gain of current control unit 211 and may therefore change the output current of the voltage regulator 100.

In case of a gain reduction, the voltage regulation loop of the voltage regulator 100 reacts in order to maintain regulation. This may be detected by observing internal nodes of the regulator 100. As soon as gain reduction (i.e. a dropout condition) is detected, the variable impedance 214 may be increased by the gain control unit 213 and by doing this the required current for driving pass transistor 201 may be reduced, thereby increasing efficiency. The driver stage unit 212 may be configured to maintain a controlled input current under all supply voltage 131 conditions.

As illustrated in FIG. 2, the internal drive currents (apart from a portion which is used for charging the pass transistor 201) may be derived from an alternative supply voltage 133 (which may be less power-efficient than the primary supply Vin 131). Consequently, the internal currents should be reduced as much as possible.

Figure 3:
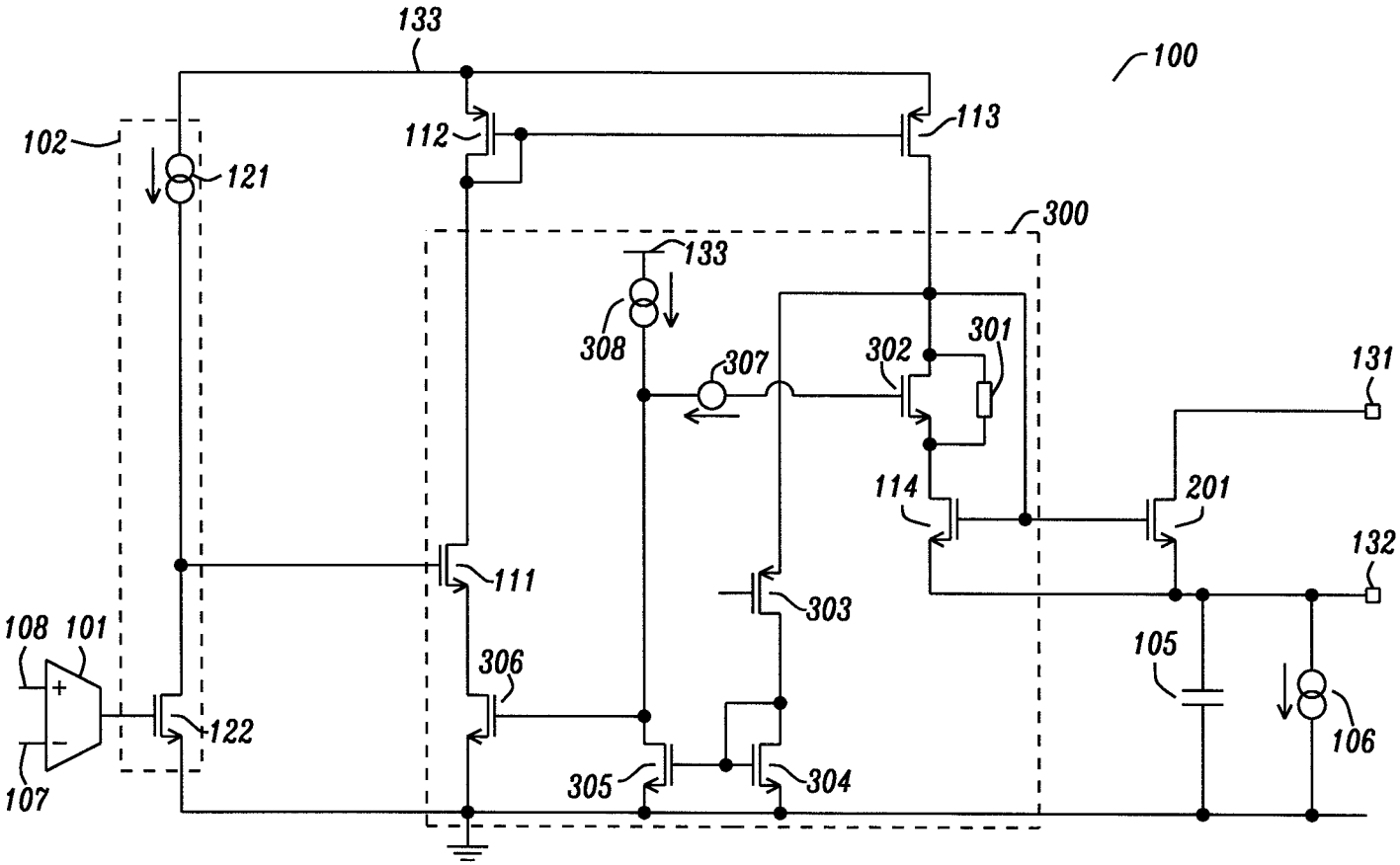
FIG. 3 shows a circuit diagram of a voltage regulator with a current reduction circuit.

FIG. 3 shows a voltage regulator 100 having an NMOS output stage 201. The voltage regulator 100 comprises circuitry for limiting the gate voltage at the gate of the pass transistor 201 in order to avoid over-voltage stress across the drive diode 114 (i.e. the drive transistor 114) and the pass transistor 201. An auxiliary transistor 302 and one or more parallel limiting devices 301 (also referred to as resistive devices, e.g. resistors) may be arranged in series to the drive diode 114, thereby forming a controllable impedance.

The circuitry 300 further comprises a voltage clamp circuit 303 for clamping the gate of the NMOS drive diode 114. Furthermore, the circuitry 300 comprises a current limit circuit comprising the NMOS transistors 304, 305, 306 and the current source 308, which acts on the voltage clamp circuit 303. The current limit circuit forms the current control unit 211 of FIG. 2. FIG. 3 also shows a voltage source 307 for providing an offset voltage.

The gate voltage of the pass transistor 201 should remain limited (to a certain maximum value) at any time. Once the gate voltage reaches such a limit, a loss-of-regulation (LoR) condition occurs. In case of a loss-of-regulation condition, the internal drive current 220 should be reduced, while maintaining the gate voltage limited, thereby increasing efficiency of the regulator 100.

The voltage clamp circuit 303 limits the gate-source voltage across the pass transistor 201 and stops a further increase of the drive current through the drive current transistor 111. The auxiliary transistor 302 reduces the current which is required for achieving this condition.

While the current limit circuit 304, 305, 306, 308 discharges the gate voltage of a current limit transistor 306 in order to reach the low regulation limit voltage (which is approximately the threshold voltage Vth of the current limit transistor 306), the auxiliary transistor 302 is also turned off. The parallel device 301 is then defining the minimum current flowing within this branch. The current limit would then settle into this lower current requirement set by device 301.

Figure 4:
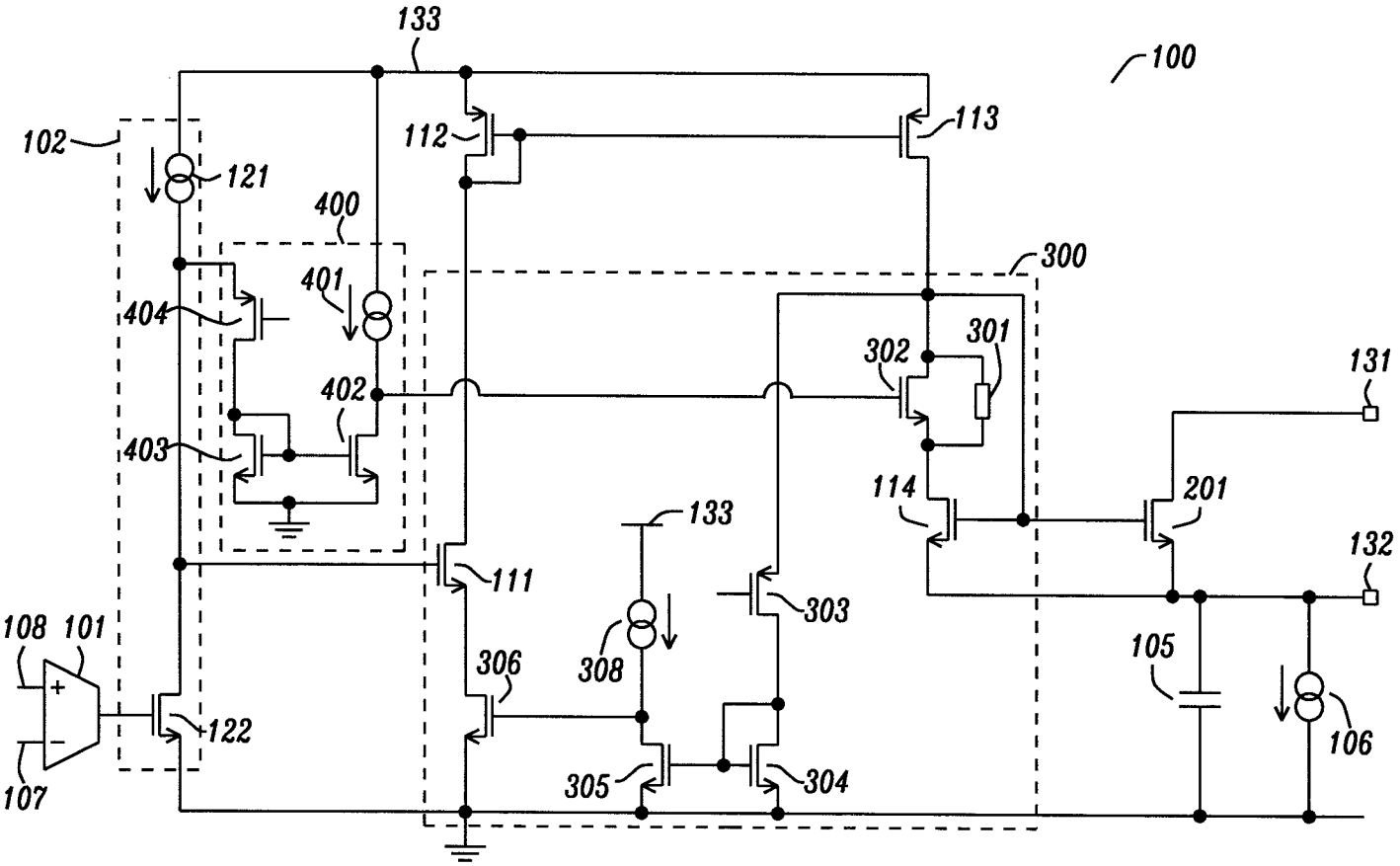
FIG. 4 shows a circuit diagram of a voltage regulator with a dropout regulation mode circuit.

FIG. 4 shows a control of the voltage clamping circuit 302 which is decoupled from the current limit circuitry. This enables a faster and more stable clamping, because the current reduction may be triggered subsequent to the activation of the regulation of the gate voltage limit. Furthermore, this enables the clamp regulation for limiting the gate voltage to operate using an increased current, thereby reducing the duration of overvoltage at the gate of the pass transistor 201.

In case of a LoR condition, a voltage increase occurs within the second stage 102. This activates the control circuit 400 for the voltage clamping circuit 302 via the transistor 404, the current mirror 403, 402 and the current source 401. As a result of this, the auxiliary transistor 302 is turned off, thereby reducing the current of the current limit loop 304, 305, 306, 308. There are a few gates shown as unconnected in FIGS. 3 and 4, since their connections are not important to the invention. For example, the gates of transistors 303 and 404 are control ports. In addition, in FIGS. 5 and 7, the gate of transistor 302 is left undefined, since there are different options for coupling transistor 302.

Figure 5:
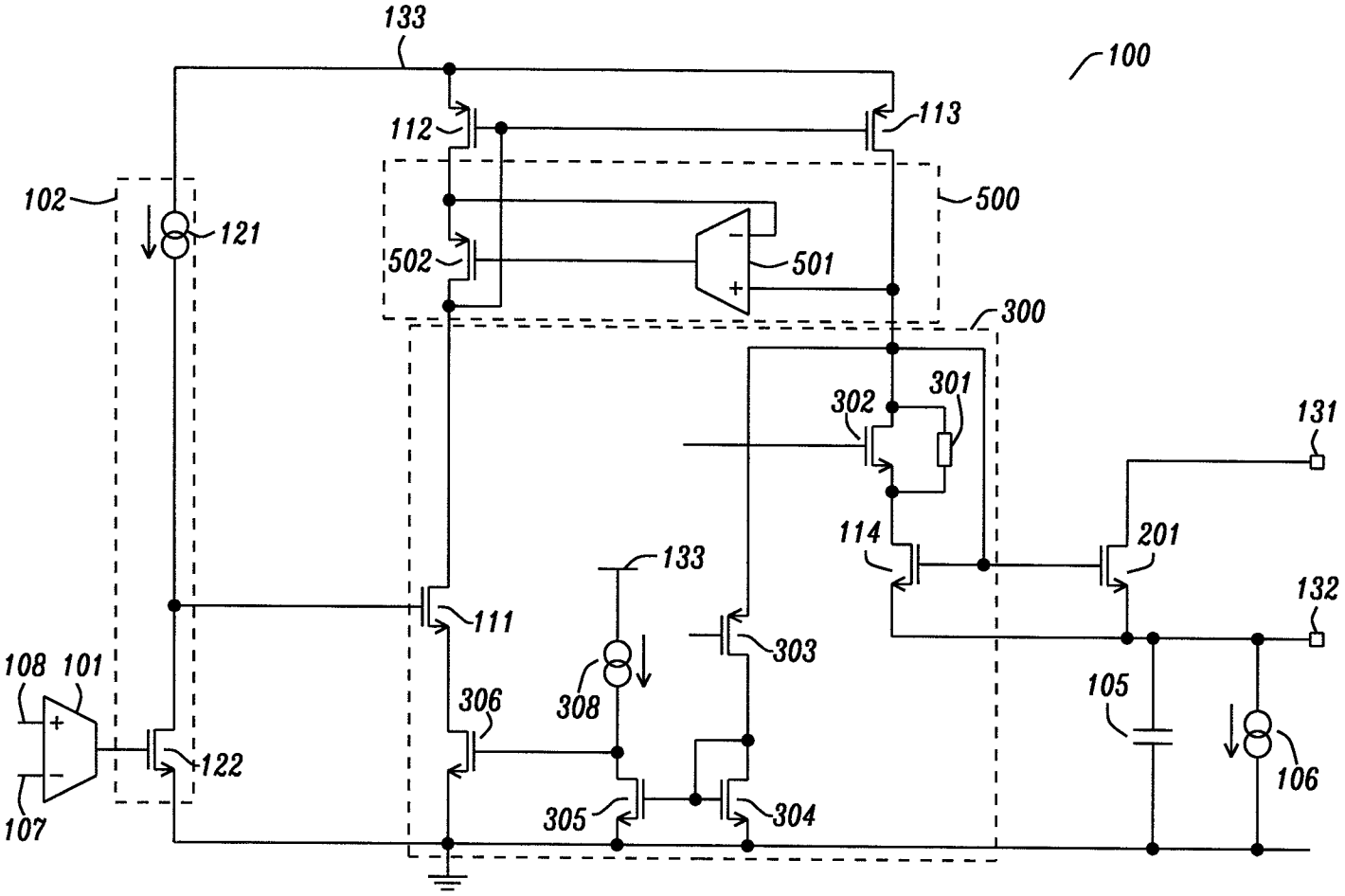
FIG. 5 shows a circuit diagram of a voltage regulator with a linearization circuit.

FIG. 5 shows a voltage regulator 100 which makes use of a wide range linear current mirror to ensure a controlled (linear) current within the drive current transistor 111, if the PMOS current mirror 112, 113 falls into dropout conditions.

As a result of this, the VDS (drain-source) voltage across the transistor 113 is also applied across the transistor 112 to enforce the same operating point and to maintain linearity of the current mirror ratio. FIG. 5 shows a possible solution for such linearity control using a regulated cascade 500 with an operational amplifier 501 and a transistor 502.

Figure 6:
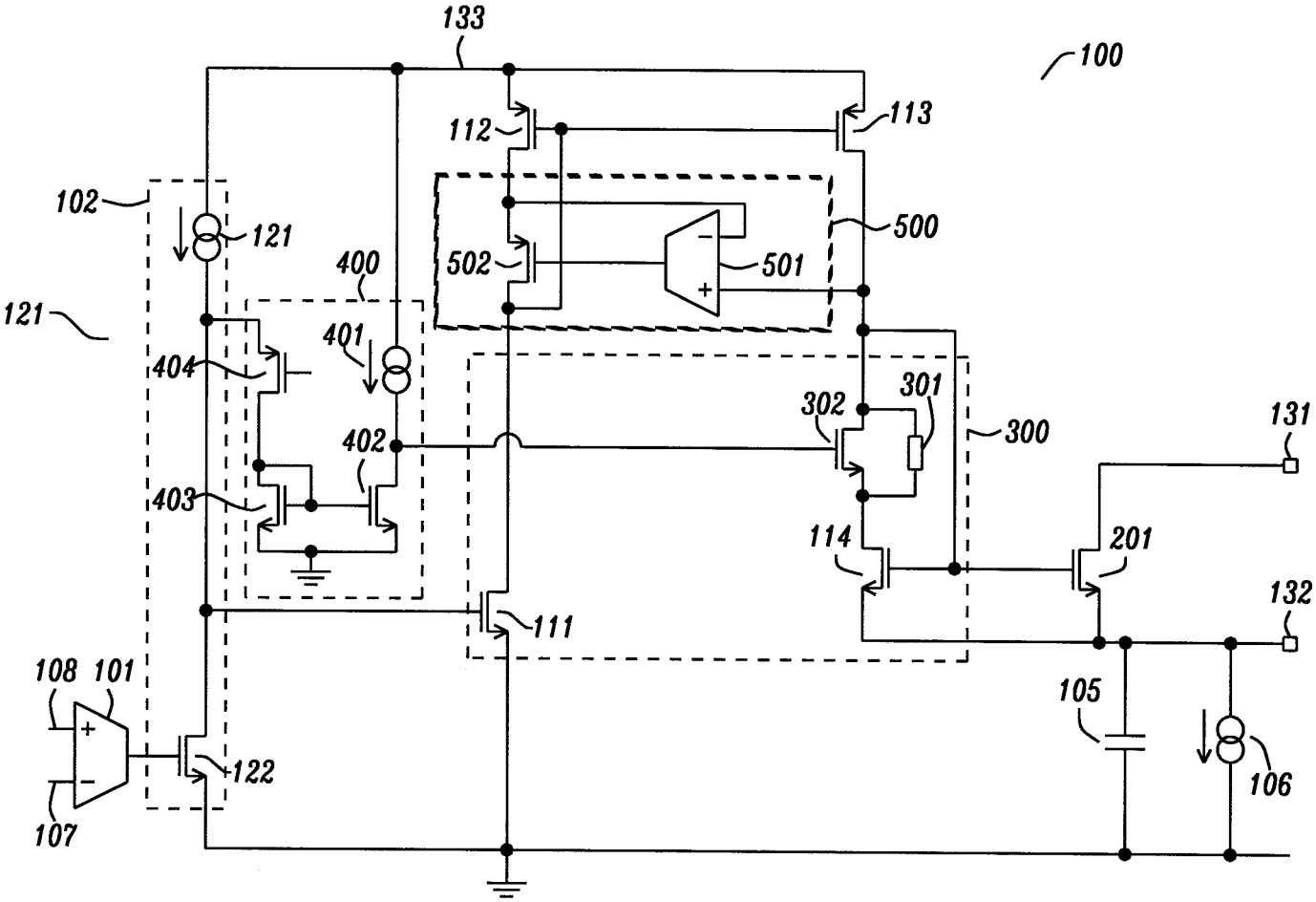
FIG. 6 shows a circuit diagram of a voltage regulator with a dropout regulation mode circuit.

FIG. 6 shows a voltage regulator 100 without transistor 303 for clamping the gate limit of the pass transistor 201. As a result of this, a supply limited gate drive with reduced internal currents is obtained. The control circuit 400 for the voltage clamping circuit 302 detects an increased current demand at the output of the regulator 100, which is indicated by an increased intermediate output voltage of the second amplification stage 102. As a result of this, the auxiliary transistor 302 is turned off, thereby reducing the drive current in the drive current transistor 111, because of the wide range current mirror 112, 113 being in dropout. The parallel device 301 to the auxiliary transistor 302 and/or a parallel device to the transistor 502 (not shown) define the minimum current in their respective branches.

Figure 7:
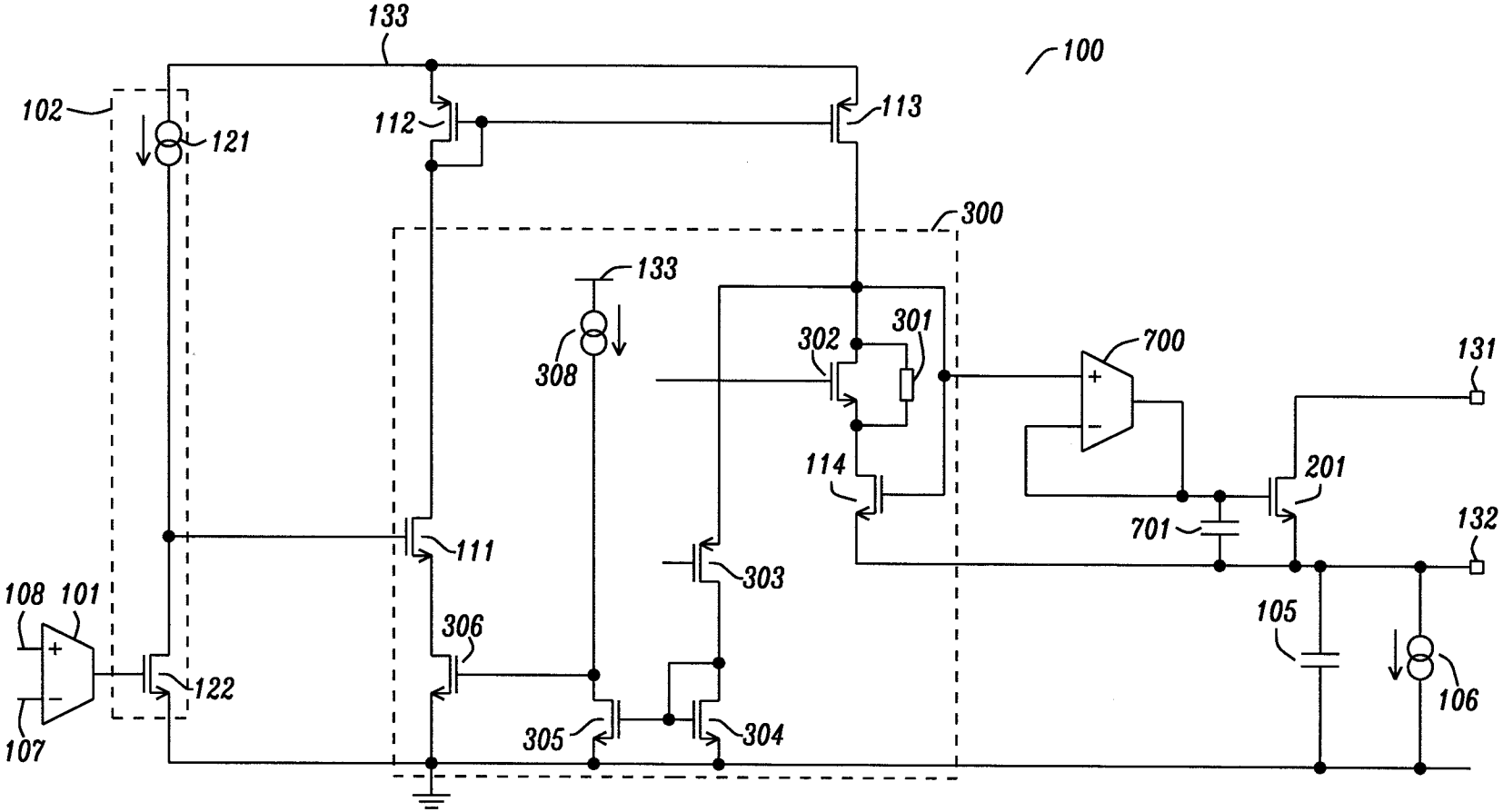
FIG. 7 shows a circuit diagram of a voltage regulator with a buffer circuit.
Figure 8:
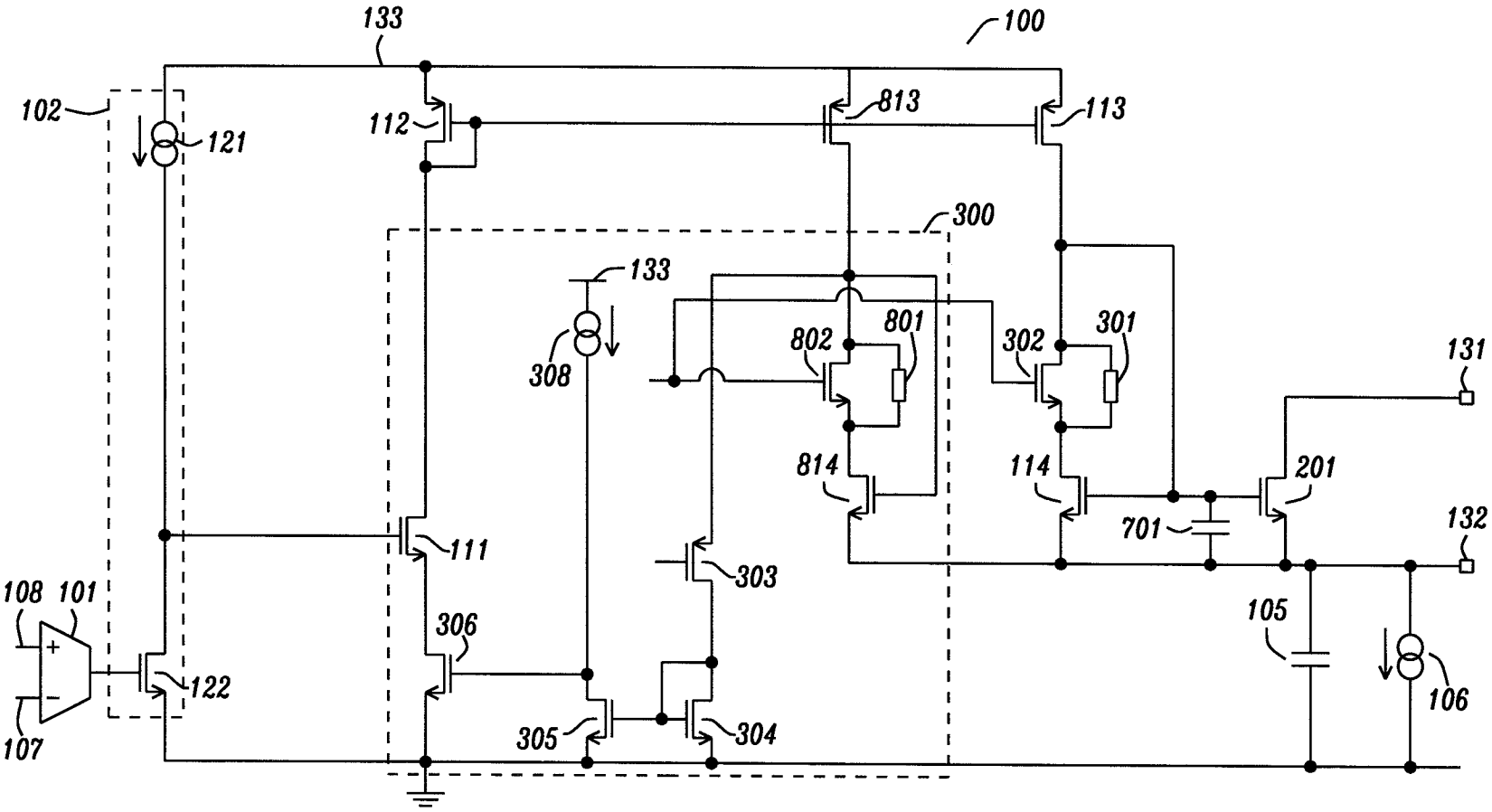
FIG. 8 shows a circuit diagram of a voltage regulator with a replica stage.

As a result of reducing the drive current (and of increasing the impedance), the pole of the output node at the transistor 302 typically changes. FIG. 7 illustrates circuitry for increasing the stability of the voltage regulator 100. In particular, FIG. 7 shows the use of a buffer 700 for decoupling the output node at the transistor 302 from the gate capacitance 701 of the pass transistor 201. In particular, the buffer 700 may be added between the drive diode 114 and the pass transistor 201. Alternatively or in addition, the decoupling may be achieved by adding a replica stage (transistors 813, 802, 814 and device 801), as shown in FIG. 8. This allows for a further reduction of internal currents while the regulation loop remains stable.

A LoR condition may occur, when the input voltage 131 drops below the output voltage 132. As a result of this, the output voltage 132 eventually drops to the level of the input voltage 131, thereby causing the gate of the pass transistor 201 to rise (in order to counter the drop of the output voltage 132). The increased gate voltage may be detected e.g. using the control circuit 400 of FIG. 6 or the circuitry shown in FIG. 3/8, thereby turning off the auxiliary transistor 302 and thereby limiting the internal currents through the drive diode 114 and/or through the drive current transistor 111. Furthermore, the gate voltage of the pass transistor 201 may be clamped to a voltage limit using the clamping transistor 303.

Figure 9:
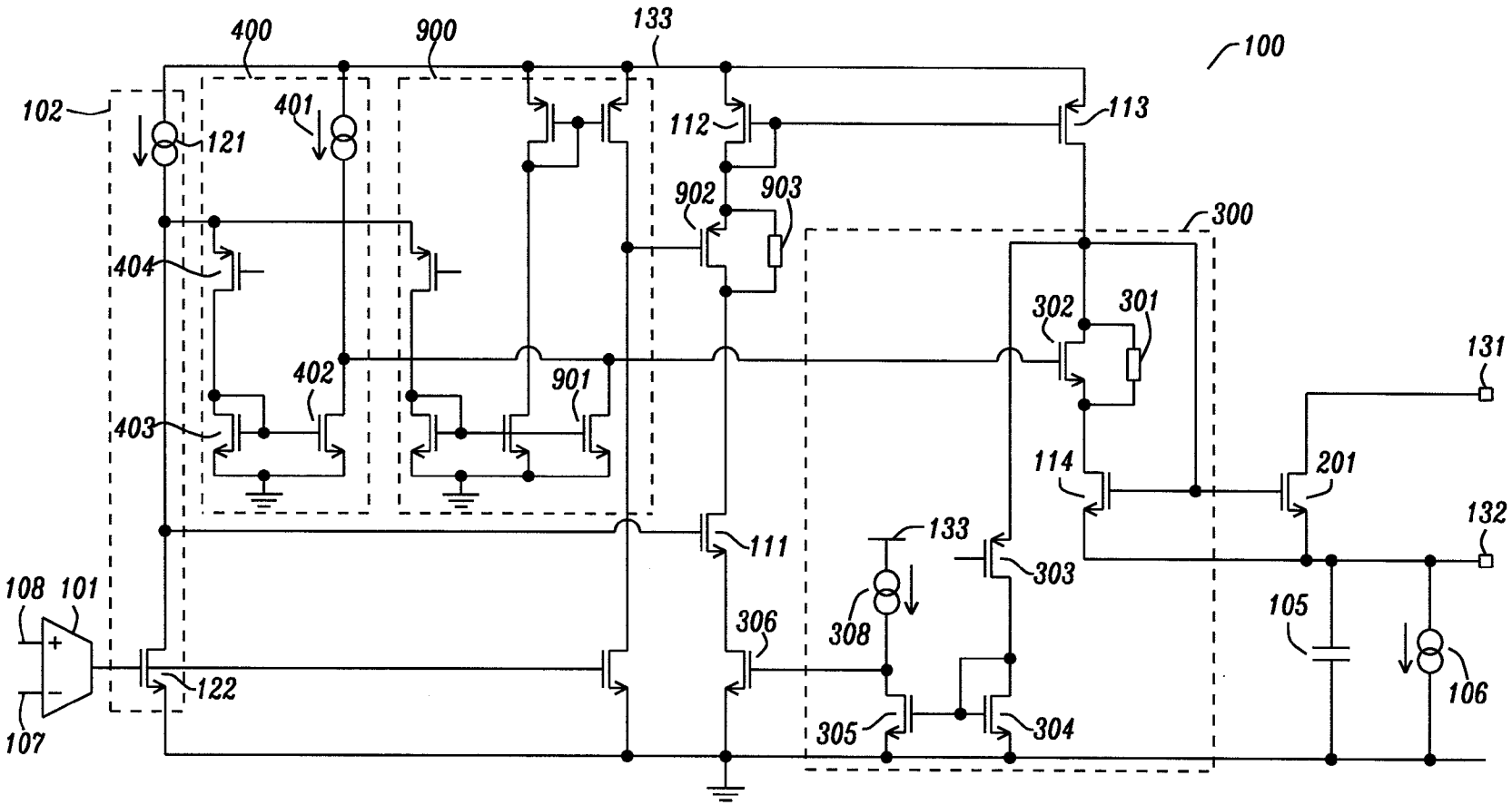
FIG. 9 shows a circuit diagram of a voltage regulator with a dropout regulation mode circuit.

FIG. 9 shows a further implementation of a voltage regulator 100 having a dropout regulation mode. The voltage regulator 100 of FIG. 9 comprises a control circuit 400 as outlined above for controlling the auxiliary transistor 302. The control circuit is enabled when the VGS limit circuit 303 and the current limit loop 304, 305, 306, 308 is activated and eventually reduces the current in transistor 306 and onwards.

It may occur that gain limitation is caused by other conditions e.g. an insufficient drive voltage across drive diode 114, when the supply voltage VDD 133 and the output voltage Vout 132 are too close. In this case the output of the second stage 102 would react, but the VGS limit loop (notably control circuit 400) would not be activated. FIG. 9 comprises a control circuit 900 which is activated subject to such a condition. This control circuit 900 controls the gate of the transistor 902, thereby reducing the current through the drive current transistor 111 as the transistor 902 (and possible replica devices) are then in linear mode. Furthermore, the auxiliary transistor 302 may be pulled low by the additional transistor 901 into the dropout regulation mode loop.

As such, the present document describes a voltage regulator 100 which is configured to provide an output current at an output voltage 132 at an output node of the voltage regulator 100, based on an input voltage 131 at an input node of the voltage regulator 100. The input voltage 131 may be different from a supply voltage 133 which is used for operating the voltage regulator 100. In particular, the input voltage 131 may be closer to the (target) output voltage 132 than the supply voltage 133, thereby increasing the efficiency of the voltage regulator 100.

The voltage regulator 100 comprises a pass transistor 201 (notably an NMOS or n-type metal oxide semiconductor transistor) for deriving the output current at the output node from the input voltage 131 at the input node. Furthermore, the voltage regulator 100 comprises a drive transistor 114 (notably an NMOS transistor) forming a current mirror in conjunction with the pass transistor 201, such that the output current through the pass transistor 201 is dependent on (notably proportional to) a drive current through the drive transistor 114 (notably to the drive diode 114). In particular, a gate of the pass transistor 201 may be (directly) coupled to a gate of the drive transistor 114. Furthermore, the sources of the pass transistor 201 and the drive transistor 114 may be (directly) coupled.

In addition, the voltage regulator 100 comprises an auxiliary transistor 302 (notably an NMOS transistor) which is arranged such that at least a fraction of the drive current through the drive transistor 114 flows through the auxiliary transistor 302. In particular, the source of the auxiliary transistor 302 may be (directly) coupled to the drain of the drive transistor 114. Furthermore, the drain of the auxiliary transistor 302 may be (directly) coupled to the gate of the drive transistor 114.

The voltage regulator 100 further comprises amplification circuitry 101, 102 which is configured to set the drive current through the drive transistor 114 in dependence of the output voltage 132 (notably of a feedback voltage 107 which is derived from, e.g. which is proportional to, the output voltage 132) and in dependence of a reference voltage 108, if the voltage regulator 100 is regulating the output voltage 132. The amplification circuitry 101, 102 may comprise a differential amplification stage 101 (notably a differential amplifier) which is configured to determine a first intermediate output voltage in dependence of the output voltage 132 and in dependence of the reference voltage 108. Furthermore, the amplification circuitry 101, 102 may comprise a drive current transistor 111 (e.g. an NMOS transistor) which is configured to generate an internal current in dependence of the first intermediate output voltage. The drive current may then be derived from the internal current (e.g. using a current mirror 112, 113). Furthermore, the amplification circuitry 101, 102 may comprise a second amplification stage 102 which is configured to generate a second intermediate output voltage in dependence of the first intermediate output voltage. The drive current transistor 111 may then be configured to generate the internal current in dependence of the second intermediate output voltage.

The voltage regulator 100 further comprises control circuitry 300, 400 which is configured to detect an indication for a dropout situation. A dropout situation may be a situation for which a difference between the input voltage 131 and the output voltage 132 falls below a dropout voltage of the voltage regulator 100. As a result of this, the voltage regulation loop of the voltage regulator 100 may be disturbed. The indication for the dropout situation may be detected e.g. based on the drive current (as illustrated e.g. in the context of FIG. 3) and/or based on the first and/or second intermediate output voltage (as illustrated e.g. in the context of FIG. 6).

The control circuitry 300, 400 may be configured to increase a resistance of the auxiliary transistor 302 in order to reduce the fraction of the drive current flowing through the auxiliary transistor 302, in reaction to detecting an indication for a dropout situation. As a result to this, the internal current within the voltage regulator 100 may be reduced during dropout of the voltage regulator 100, thereby reducing the power consumption of the voltage regulator 100.

The voltage regulator 100 may comprise a resistive device 301 which is arranged in parallel to the auxiliary transistor 302, wherein the resistive device 301 may e.g. comprise a resistor. The (entire) drive current may then flow through the parallel arrangement of the auxiliary transistor 302 and the resistive device 301. By making use of a resistive device 301, the internal current within the voltage regulator 100 may be limited in a reliable and precise manner.

The voltage regulator 100 may comprise circuitry 304, 305, 308 for determining an indication of the drive current and for comparing the indication of the drive current with a first dropout reference current. In particular, the control circuit 300, 400 may comprise a first current mirror 304, 305 (notably an NMOS current mirror) and a first current source 308, wherein the first current source 308 is configured to provide the first dropout reference current. A first input transistor 304 (notably an NMOS transistor) of the first current mirror 304, 305 may be coupled to the auxiliary transistor 302. In particular, a drain of the first input transistor 304 may be (directly or indirectly) coupled to a drain of the auxiliary transistor 302. A first output transistor 305 (e.g. an NMOS transistor) of the first current mirror 304, 305 may be coupled to the first current source 308.

The circuitry 304, 305, 308 for determining an indication of the drive current and for comparing the indication of the drive current with a first dropout reference current may be part of the control circuit 300, 400, and the indication for a dropout situation may be detected based on the comparison between the indication of the drive current and the first dropout reference current. In particular, a gate of the auxiliary transistor 302 may be coupled to a midpoint between the first output transistor 305 and the first current source 308, notably via an offset voltage 307. As a result of this, the auxiliary transistor 302 may be turned off (e.g. with a certain delay given by the offset voltage 307), if the midpoint between the first output transistor 305 and the first current source 308 indicates that the drive current increases (e.g. beyond the first dropout reference current). Hence, a reliable detection for a dropout situation is provided.

The voltage regulator 100 may comprise a voltage clamp transistor 303 (e.g. a PMOS transistor) which is configured to clamp the drive voltage at the gate of the pass transistor 201 to a fixed voltage level (notably if a dropout situation has been detected). The voltage clamp transistor 303 may be arranged in series with the first input transistor 304. Furthermore, the (source of the) voltage clamp transistor 303 may be coupled to the gate of the pass transistor 201 and to the drain of the auxiliary transistor 302. Furthermore, the drain of the voltage clamp transistor 303 may be coupled (directly) to the drain of the first input transistor 304. By clamping the gate of the pass transistor 201 to a fixed voltage level, the pass transistor 201 and/or the drive transistor 114 may be protected during a dropout situation, while maintaining the pass transistor 201 turned on (to reduce power losses of the voltage regulator 100).

The voltage regulator 100 may comprise a current limit transistor 306 (e.g. an NMOS transistor) which is arranged in series with the drive current transistor 111. In particular, a drain of the current limit transistor 306 may be coupled to a source of the drive current transistor 111. The current limit transistor 306 may be controlled based on the comparison between the indication of the drive current and the first dropout reference current, notably based on the voltage level at the midpoint between the first output transistor 305 and the first current source 308. For this purpose, the gate of the current limit transistor 306 may be coupled (directly) to the midpoint between the first output transistor 305 and the first current source 308. By making use of a current limit transistor 306, the current limitation within the voltage regulator 100 may be further improved.

The voltage regulator 100 may comprise a second current mirror 112, 113 (e.g. a PMOS current mirror) which comprises a second input transistor 112 (e.g. a PMOS transistor) which is arranged in series with the drive current transistor 111 and a second output transistor 113 (e.g. a PMOS transistor) which is arranged in series with the auxiliary transistor 302. In particular, a drain of the second input transistor 112 may be (directly) coupled to a drain of the drive current transistor 111. Furthermore, a drain of the second output transistor 113 may be (directly) coupled to the drain of the auxiliary transistor 302. The second current mirror 112, 113 may be used to generate the drive current from the current flowing through the drive current transistor 111.

As indicated above, the second current mirror 112, 113 may be a p-type current mirror. The voltage regulator 100 may comprise circuitry 500 for enforcing the gate-drain voltage across the second input transistor 112 to be equal to the gate-drain voltage across the second output transistor 113. By doing this, the linearity of the second current mirror 112, 113 may be improved.

The control circuit 300, 400 may be configured to control the auxiliary transistor 302 in dependence of the second intermediate output voltage. In other words, a dropout situation may be detected based on the second intermediate output voltage. The control circuit 300, 400 may comprise circuitry 404 (e.g. a (PMOS) transistor) for generating a control current in dependence of the second intermediate output voltage. The second intermediate output voltage may be applied to a source of the PMOS transistor. Furthermore, the control circuit 300, 400 may comprise circuitry 401, 402, 403 for comparing the control current with a second dropout reference current, wherein the auxiliary transistor 302 is controlled in dependence of the comparison between the control current and the second dropout reference current. In particular, the circuitry 401, 402, 403 for comparing may comprise a current mirror 402, 403 and a current source 401 for generating the second dropout reference current. A midpoint between the output transistor 402 of the current mirror 402, 403 and the current source 401 may be (directly) coupled to the gate of the auxiliary transistor 302. By doing this, a dropout situation may be detected in a reliable manner and internal currents may be reduced accordingly.

The amplification circuitry 101, 102 may be operated using a supply voltage 133 which is different from the input voltage 131 (wherein the supply voltage 133 is typically higher than the input voltage 131). The pass transistor 201 is typically controlled via a drive voltage applied to the gate of the pass transistor 201. The voltage regulator 100 may comprise a second auxiliary transistor 902 (e.g. a PMOS transistor) which is arranged in series with the drive current transistor 111. A drain of the second auxiliary transistor 902 may be coupled to the drain of the drive current transistor 111. Furthermore, a source of the second auxiliary transistor 902 may be coupled to the drain of the second input transistor 112 of the second current mirror 112, 113. Furthermore, a second resistive device (e.g. a resistor) may be arranged parallel to the second auxiliary transistor 902.

The voltage regulator 100 may comprise second control circuitry 900 which is configured to detect an indication for a situation where the drive voltage is insufficient for enabling the voltage regulator 100 to regulate the output voltage 132. Such a situation may occur e.g. when the supply voltage 133 becomes too close to the output voltage 132. The control circuitry 900 may be further configured, in reaction to detecting such a situation, to increase a resistance of the second auxiliary transistor 902 to reduce the internal current through the drive current transistor 111. By doing this the power efficiency of the voltage regulator 100 may be further increased.

The voltage regulator 100 may comprise decoupling circuitry 700, 802, 813, 814 for decoupling the amplification circuitry 101, 102 from a gate capacitance 701 of the pass transistor 201. The decoupling circuitry 700, 802, 813, 814 may comprise e.g. a buffer 700 which is arranged between the gate of the drive transistor 114 and the gate of the pass transistor 201. Alternatively or in addition, the decoupling circuitry 700, 802, 813, 814 may comprise e.g. replica circuitry 813, 814, 802 of the auxiliary transistor 302 and of the drive transistor 114. By making use of decoupling circuitry 700, 802, 813, 814, the stability of the voltage regulator 100 may be increased (notably during dropout situations).

Figure 10:
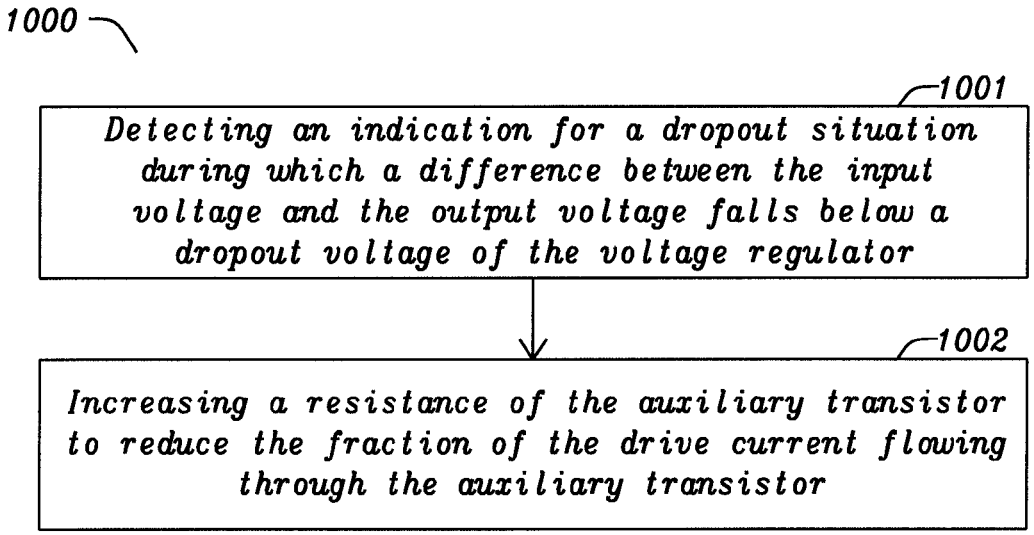
FIG. 10 shows a flow chart of an example method for operating a voltage regulator.

FIG. 10 shows a flow chart of an example method 1000 for operating a voltage regulator 100. As outlined above, the voltage regulator 100 comprises a pass transistor 201 for deriving an output current at an output voltage 132 from an input voltage 131. Furthermore, the voltage regulator 100 comprises a drive transistor 114 forming a current mirror in conjunction with the pass transistor 201, such that the output current through the pass transistor 201 is dependent on a drive current through the drive transistor 114. In addition, the voltage regulator 100 comprises an auxiliary transistor 302 which is arranged such that at least a fraction of the drive current through the drive transistor 114 flows through the auxiliary transistor 302. Furthermore, the voltage regulator 100 comprises amplification circuitry 101, 102 which is configured to set the drive current through the drive transistor 114 in dependence of the output voltage 132 and in dependence of a reference voltage 108, if the voltage regulator 100 is regulating the output voltage 132.

The method 1000 comprises detecting 1001 an indication for a dropout situation during which a difference between the input voltage 131 and the output voltage 132 falls below a dropout voltage of the voltage regulator 100. Furthermore, the method 1000 comprises, in reaction to this, increasing 1002 a resistance of the auxiliary transistor 302 to reduce the fraction of the drive current flowing through the auxiliary transistor 302.

It should be noted that the description and drawings merely illustrate the principles of the proposed methods and systems. Those skilled in the art will be able to implement various arrangements that, although not explicitly described or shown herein, embody the principles of the invention and are included within its spirit and scope. Furthermore, all examples and embodiment outlined in the present document are principally intended expressly to be only for explanatory purposes to help the reader in understanding the principles of the proposed methods and systems. Furthermore, all statements herein providing principles, aspects, and embodiments of the invention, as well as specific examples thereof, are intended to encompass equivalents thereof.

What is claimed is:

1. A voltage regulator configured to provide an output current at an output voltage at an output node, based on an input voltage at an input node, wherein the voltage regulator comprises, a pass transistor for deriving the output current at the output node from the input voltage at the input node;

a drive transistor forming a current minor in conjunction with the pass transistor, such that the output current through the pass transistor is dependent on a drive current through the drive transistor;

an auxiliary transistor arranged such that at least a fraction of the drive current through the drive transistor flows through the auxiliary transistor;

amplification circuitry configured to set the drive current through the drive transistor in dependence of the output voltage and in dependence of a reference voltage, if the voltage regulator is regulating the output voltage; and control circuitry configured to detect an indication for a dropout situation where a difference between the input voltage and the output voltage falls below a dropout voltage of the voltage regulator; and in reaction to this, increase a resistance of the auxiliary transistor to reduce the fraction of the drive current flowing through the auxiliary transistor.

2. The voltage regulator of claim 1, wherein the voltage regulator comprises a resistive device which is arranged in parallel to the auxiliary transistor;

the drive current flows through the parallel arrangement of the auxiliary transistor and the resistive device; and the resistive device comprises e.g. a resistor.

3. The voltage regulator of claim 1, wherein the voltage regulator comprises circuitry for determining an indication of the drive current and for comparing the indication of the drive current with a first dropout reference current.

4. The voltage regulator of claim 3, wherein the circuitry for determining an indication of the drive current and for comparing the indication of the drive current with a first dropout reference current is part of the control circuit; and the indication for a dropout situation is detected based on the comparison between the indication of the drive current and the first dropout reference current.

5. The voltage regulator of claim 1, wherein the control circuit comprises a first current mirror and a first current source configured to provide a first dropout reference current;

a first input transistor of the first current mirror is coupled to the auxiliary transistor; and a first output transistor of the first current mirror is coupled to the first current source.

6. The voltage regulator of claim 5, wherein a gate of the auxiliary transistor is coupled to a midpoint between the first output transistor and the first current source; and the gate of the auxiliary transistor is coupled to the midpoint between the first output transistor and the first current source e.g. via an offset voltage.

7. The voltage regulator of claim 5, wherein the voltage regulator comprises a voltage clamp transistor configured to clamp a drive voltage at a gate of the pass transistor to a fixed voltage level;

the voltage clamp transistor is arranged in series with the first input transistor; and the voltage clamp transistor is coupled to the gate of the pass transistor and to a drain of the auxiliary transistor.

8. The voltage regulator of claim 1, wherein the amplification circuitry comprises a differential amplification stage configured to determine a first intermediate output voltage in dependence of the output voltage and in dependence of the reference voltage; and a drive current transistor configured to generate an internal current in dependence of the first intermediate output voltage; wherein the drive current is dependent on the internal current.

9. The voltage regulator of claim 8, wherein the voltage regulator comprises a current limit transistor which is arranged in series with the drive current transistor; and the current limit transistor is controlled based on the comparison between the indication of the drive current and the first dropout reference current, notably based on a voltage at the midpoint between the first output transistor and the first current source.

10. The voltage regulator of claim 8, wherein the voltage regulator comprises a second current mirror comprising a second input transistor which is arranged in series with the drive current transistor and a second output transistor which is arranged in series with the auxiliary transistor.

11. The voltage regulator of claim 10, wherein the second current mirror is a p-type current mirror; and the voltage regulator comprises circuitry for enforcing a gate-drain voltage across the second input transistor to be equal to a gate-drain voltage across the second output transistor.

12. The voltage regulator of claim 8, wherein the amplification circuitry comprises a second amplification stage configured to generate a second intermediate output voltage in dependence of the first intermediate output voltage;

the drive current transistor is configured to generate the internal current in dependence of the second intermediate output voltage; and the control circuit is configured to control the auxiliary transistor in dependence of the second intermediate output voltage.

13. The voltage regulator of claim 12, wherein the control circuit comprises circuitry for generating a control current in dependence of the second intermediate output voltage; and circuitry for comparing the control current with a second dropout reference current; wherein the auxiliary transistor is controlled in dependence of the comparison between the control current and the second dropout reference current.

14. The voltage regulator of claim 8, wherein the amplification circuitry is operated using a supply voltage which is different from the input voltage;

the pass transistor is controlled via a drive voltage applied to a gate of the pass transistor;

the voltage regulator comprises a second auxiliary transistor arranged in series with the drive current transistor; and the voltage regulator comprises second control circuitry configured to detect an indication for a situation where the drive voltage is insufficient for enabling the voltage regulator to regulate the output voltage; and in reaction to this, increase a resistance of the second auxiliary transistor to reduce the internal current through the drive current transistor.

15. The voltage regulator of claim 1, wherein the voltage regulator comprises decoupling circuitry for decoupling the amplification circuitry from a gate capacitance of the pass transistor;

the decoupling circuitry comprises e.g. a buffer arranged between a gate of the drive transistor and a gate of the pass transistor; and/or the decoupling circuitry comprises e.g. replica circuitry of the auxiliary transistor and of the drive transistor.

16. A method for operating a voltage regulator, wherein the voltage regulator comprises: a pass transistor for deriving an output current at an output voltage from an input voltage, a drive transistor forming a current mirror in conjunction with the pass transistor, such that the output current through the pass transistor is dependent on a drive current through the drive transistor, an auxiliary transistor arranged such that at least a fraction of the drive current through the drive transistor flows through the auxiliary transistor, and amplification circuitry to set the drive current through the drive transistor in dependence of the output voltage and in dependence of a reference voltage, if the voltage regulator is regulating the output voltage; wherein the method comprises detecting an indication for a dropout situation where a difference between the input voltage and the output voltage falls below a dropout voltage of the voltage regulator; and in reaction to this, increasing a resistance of the auxiliary transistor to reduce the fraction of the drive current flowing through the auxiliary transistor.

17. The method of claim 16, wherein the voltage regulator comprises a resistive device which is arranged in parallel to the auxiliary transistor;

the drive current flows through the parallel arrangement of the auxiliary transistor and the resistive device; and the resistive device comprises e.g. a resistor.

18. The method of claim 16, wherein the voltage regulator comprises circuitry for determining an indication of the drive current and for comparing the indication of the drive current with a first dropout reference current.

19. The method of claim 18, wherein the circuitry for determining an indication of the drive current and for comparing the indication of the drive current with a first dropout reference current is part of the control circuit; and the indication for a dropout situation is detected based on the comparison between the indication of the drive current and the first dropout reference current.

20. The method of claim 16, wherein the control circuit comprises a first current mirror and a first current source to provide a first dropout reference current;

a first input transistor of the first current mirror is coupled to the auxiliary transistor; and a first output transistor of the first current mirror is coupled to the first current source.

21. The method of claim 20, wherein a gate of the auxiliary transistor is coupled to a midpoint between the first output transistor and the first current source; and the gate of the auxiliary transistor is coupled to the midpoint between the first output transistor and the first current source e.g. via an offset voltage.

22. The method of claim 20, wherein the voltage regulator comprises a voltage clamp transistor to clamp a drive voltage at a gate of the pass transistor to a fixed voltage level;

the voltage clamp transistor is arranged in series with the first input transistor; and the voltage clamp transistor is coupled to the gate of the pass transistor and to a drain of the auxiliary transistor.

23. The method of claim 16 wherein the amplification circuitry comprises a differential amplification stage to determine a first intermediate output voltage in dependence of the output voltage and in dependence of the reference voltage; and a drive current transistor to generate an internal current in dependence of the first intermediate output voltage; wherein the drive current is dependent on the internal current.

24. The method of claim 23, wherein the voltage regulator comprises a current limit transistor which is arranged in series with the drive current transistor; and the current limit transistor is controlled based on the comparison between the indication of the drive current and the first dropout reference current, notably based on a voltage at the midpoint between the first output transistor and the first current source.

25. The method of claim 23, wherein the voltage regulator comprises a second current mirror comprising a second input transistor which is arranged in series with the drive current transistor and a second output transistor which is arranged in series with the auxiliary transistor.

* * * * *